428-408 SR
11/27/79 XR 4,176,336

United States Patent [19]
Van Den Berk et al.

[11] 4,176,336
[45] Nov. 27, 1979

[54] LACQUER-ENCAPSULATED CARBON FILM RESISTOR

[75] Inventors: Peter J. T. Van Den Berk; Gerrit Verspui, both of Eindhoven, Netherlands

[73] Assignee: U.S. Philips Corporation, New York, N.Y.

[21] Appl. No.: 913,292

[22] Filed: Jun. 7, 1978

[30] Foreign Application Priority Data

Jun. 27, 1977 [NL] Netherlands ..... 7707078

[51] Int. Cl.[2] ..... H01C 1/024; H01C 1/032; H01C 1/02; B05D 5/12

[52] U.S. Cl. ..... 338/274; 338/237; 427/103; 428/408; 428/428; 29/613; 338/308; 338/273

[58] Field of Search ..... 428/408, 428, 432, 538, 428/539, 336; 427/101, 103; 338/237, 226, 272, 273, 274, 308; 29/613, 620

[56] References Cited

U.S. PATENT DOCUMENTS

| | | | |
|---|---|---|---|
| 3,244,559 | 4/1966 | Sivertsen et al. | 428/408 |
| 3,637,423 | 1/1972 | Sestrich | 428/408 X |
| 3,776,772 | 12/1973 | Asada et al. | 428/428 |
| 3,808,045 | 4/1974 | Knyazhev et al. | 427/103 X |
| 3,922,388 | 11/1975 | Schebalin | 427/103 |
| 3,982,218 | 9/1976 | Adler et al. | 427/103 X |
| 4,122,211 | 10/1978 | Kikuga et al. | 427/103 |

*Primary Examiner*—George F. Lesmes
*Assistant Examiner*—Daniel R. Zirker
*Attorney, Agent, or Firm*—Thomas A. Briody; Edward J. Connors, Jr.; James J. Cannon, Jr.

[57] ABSTRACT

A lacquer-encapsulated carbon film resistor having a ceramic substrate coated with a carbon film, a silicon nitride layer, an organic lacquer layer and termination electrodes.

2 Claims, 1 Drawing Figure

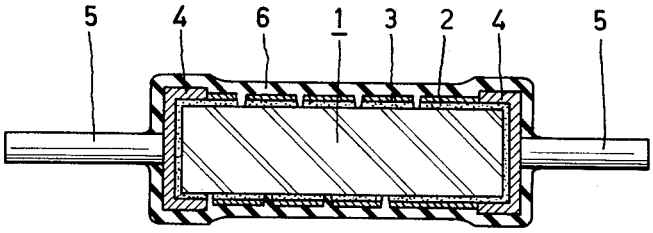
5
4
6
1
3
2
4
5

LACQUER-ENCAPSULATED CARBON FILM RESISTOR

BACKGROUND OF THE INVENTION

1. Field of the Invention

The invention relates to a carbon film resistor having a non-conducting substrate provided with a carbon film, a top coating of inorganic material, an electrically insulating layer and electrodes which contact the carbon film.

2. Description of the Prior Art

U.S. Pat. No. 3,244,559 discloses a carbon film resistor of this type. With this carbon film resistor the electrically insulating layer which may, for example, consist of a glass coating or encapsulation, hermetically seals the subjacent carbon film with top coating. With this prior art carbon film resistor the top coating consists of a high-melting metal oxide obtained by decomposing an organic compound. The coating or encapsulation of glass is necessary because the top coating of a high-melting oxide, for example, silicon dioxide, after the resistance has been brought to the desired value by locally removing, scoring etc. of the carbon film no longer protects the side faces of the carbon film then exposed from attack by the atmosphere.

SUMMARY OF THE INVENTION

It is an object of the invention to provide qualitatively comparable resistors of a simpler construction. A carbon film resistor which satisfies this object is characterized in that the top coating consists of silicon nitride which is encapsulated by an organic lacquer layer. The resistance can be brought in the customary manner to the desired value by grinding, scoring or otherwise locally removing the carbon film together with the top coating. It was surprisingly found that encapsulation with an organic lacquer-layer is sufficient, and that a hermetic seal is required for the construction described in the above-mentioned U.S. Pat. No. 3,244,559 can be dispensed with.

The resistors are produced in the customary manner. Cylindrical bodies of a ceramic material are provided with a carbon film by means of a chemical vapour deposition process. Thereafter a silicon nitride layer is applied also by means of a chemical vapour deposition process. The thickness of the deposited layer may, for example, be between 0.05 and 0.5 μm. Hereafter cap-shaped electrodes are pushed on the ends of the cylinder. The resistors are brought to the desired value by removing a portion of the carbon film, while the resistance value is continuously measured. The encapulation is obtained by coating the resistors with one single lacquer layer. The lacquer may, for example, consist of an epoxy resin. The resistors according to the invention were subjected to an accelerated "moisture" test. It was found that, for resistors having a resistance value exceeding 1000 k Ω, after having been immersed in boiling water for 1 hour, the resistance value increases by less than 1% if thereafter the resistor is charged to the rated voltage. If no silicon nitride layer is applied and only five superimposed lacquer layers of a high quality are applied then the resistance value increases in these circumstances by at least 10%. In some cases the carbon film is then even interrupted.

The resistors according to the invention are well protected from overloading and substantially insensitive to electrochemical corosion. They have a long life at an elevated operating temperatures.

BRIEF DESCRIPTION OF THE DRAWING

The invention will be described in greater detail with reference to the accompanying drawings, the sole FIGURE of which shows in cross-section an embodiment of a carbon film resistor according to the invention.

DESCRIPTION OF THE PREFERRED EMBODIMENT

In the FIGURE the numerals have the following meaning:

1=cylindrical ceramic body
2=carbon film
3=top coating of silicon nitride
4=electrode caps
5=current conductor
6=lacquer layer.

The resistors of the preferred embodiment are made as follows.

A large number of cylindrical bodies 1 of a ceramic material on the basis of aluminum oxide having a diameter of 2.5 mm and a length of 5 mm are exposed in a rotating drum to a gas current of 1% by volume of methane ($CH_4$), remainder nitrogen ($N_2$) at 1050° C. and a pressure of 1 atmosphere. After a carbon film of approximately 0.08 μm has been deposited the methane-containing gas current is replaced by a gas current consisting of 18% by volume of ammonia ($NH_3$), 0, 15% by volume of silicon hydride ($SiH_4$) remainder nitrogen ($N_2$) and the temperature is raised to 900° C. The bodies having a silicon nitride film, 0, 1 μm thick, are provided with metal electrode caps 4 which are pushed on to the ends, so that the silicon nitride film 3 is locally removed and a proper electric contact with the carbon film is obtained. Thereafter current conductors 5 are connected to the electrode caps by means of resistance welding.

Thereafter the resistors are brought to the desired value by making a helical incision in the carbon film while continuously measuring the resistance.

The finished resistors are thereafter coated with a single lacquer layer on the basis of an epoxy resin.

Resistors obtained in this manner having a resistance value of 1 M Ωwere immersed for 1 hour in water having a temperature of 100° C. Thereafter the resistors are charged in a room having a relative humidity of 95% for one hour at the rated voltage (250 V). The increase in resistance was not more than 0.5%. With resistors without silicon nitride layer the resistance value increased by at least 10%. However, some resistor films appeared to have been interrupted. If the resistors are charged in air in such circumstances that they become red hot, the resistors according to the invention appeared to return to the original value when cooled. If no silicon nitride layer is provided the carbon film is fully burnt.

What is claimed is:

1. A lacquer-encapsulated carbon film resistor comprising:

a ceramic substrate;

a carbon film deposited over the entire surface of said ceramic substrate;

an insulating layer of silicon nitride deposited substantially over the entire surface of said carbon film, only the electrical connection portions of said carbon film being uncoated;

metal electrode caps positioned tightly against said carbon film at said electrical connection portions;

current conductors welded to said metal electrode caps to serve as leads;

a layer of epoxy resin lacquer coated over said entire carbon film resistor assembly except said leads to encapsulate said resistor.

2. A lacquer-encapsulated carbon film resistor as claimed in claim 1, wherein the thickness of the silicon nitride layer is between 0.05 and 0.5 μm.

* * * * *